US007143715B2

(12) United States Patent
Howlett

(10) Patent No.: US 7,143,715 B2
(45) Date of Patent: Dec. 5, 2006

(54) OUTBOARD SKEG

(75) Inventor: James Jay Howlett, Salt Lake City, UT (US)

(73) Assignee: James J. Howlett, Kaysville, UT (US)

( * ) Notice: Subject to any disclaimer, the term of this patent is extended or adjusted under 35 U.S.C. 154(b) by 0 days.

(21) Appl. No.: 11/007,693

(22) Filed: Dec. 7, 2004

(65) Prior Publication Data

US 2006/0118023 A1 Jun. 8, 2006

(51) Int. Cl.
*B63B 35/00* (2006.01)

(52) U.S. Cl. ..... 114/347; 114/165; 114/162

(58) Field of Classification Search ..... 114/347, 114/163–165
See application file for complete search history.

(56) References Cited

U.S. PATENT DOCUMENTS 4,556,006 A * 12/1985 Kaupat ..... 114/162
5,711,692 A * 1/1998 Pope ..... 441/74

* cited by examiner

*Primary Examiner*—Ed Swinehart

(57) ABSTRACT

This invention can be fitted to a variety of vessels and accommodate a variety of accessories that may require deployment or retraction such as electronic equipment, downrigger or an outboard skeg mechanism as detailed in the preferred embodiment. This invention in it's preferred embodiment is shown on, but not limited to, the stern of a kayak. It increases the efficiency of linear tracking, allows the handling characteristics of an aquatic vessel to be tuned, and reduces the amount of technical skill required to control the vessel. It can have control linkage to deploy or retract it, can be stowed separate from the vessel, is lightweight, and is easy to assemble and operate.

3 Claims, 7 Drawing Sheets

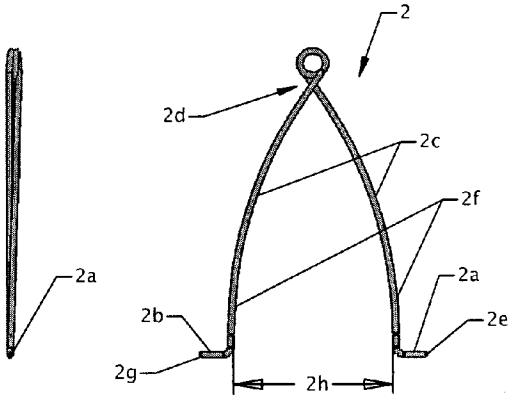
FIG. 7
FIG. 8
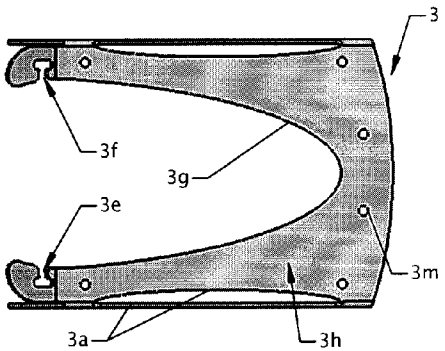
FIG. 9
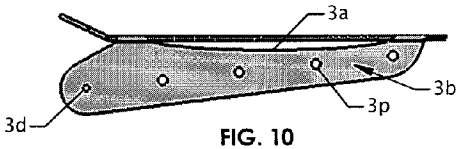
FIG. 10
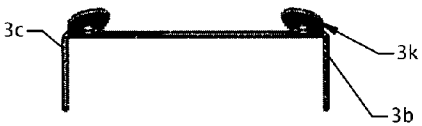
FIG. 11
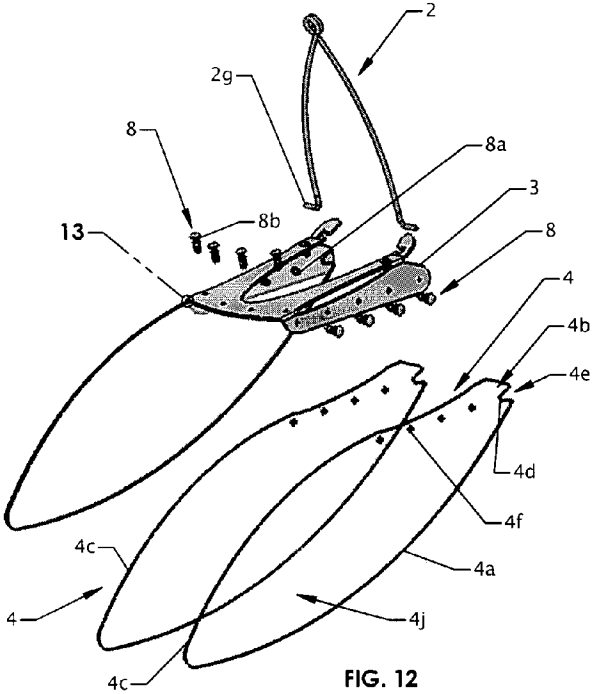
FIG. 12
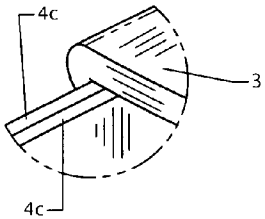
FIG. 13

OUTBOARD SKEG

BACKGROUND OF THE INVENTION

Kayak hull design has progressed to target specific handling characteristics that are desirable for the conditions in which it will be used. Prior to this invention there was not an easily adaptable accessory that could change the handling characteristics of a kayak hull that was designed to be very maneuverable.

Kayaks can have a variety of hull configurations that represent the keel of a traditional boat. A keel that is proud of the hull surface will have better linear tracking, than that of a boat with a smooth bottom. The vessel shown in the preferred embodiment does not have a defined keel, which is a generally longitudinal plane down the midline of the vessel, and is referred to in this writing as the virtual keel.

A vessel without a defined keel is typically very maneuverable, which also means it doesn't track in a linear manner very well. For a man powered aquatic vessel to track properly, the same amount of propelling force needs to be applied to the left side as the right side. If one side is favored, there is an amount of latent energy that will need to be released. This manifestation of energy can show itself by having the vessel turning in a direction other than its intended vector. This is wasted energy that could have been channeled in a positive direction. Technical skill and experience are required to make a smooth bottom vessel track in a linear fashion, and to minimize the loss of energy. Furthermore forces that can cause the deviation of a vessel heading include, but are not limited to wind, waves, current, primary propulsion and auxiliary propulsion.

Prior to this invention a method for changing the handling and tracking characteristics, on a vessel that tracked poorly, was to add an inboard skeg. To install a previously designed retractable skeg into an existing hull takes a fair amount of tools, special materials, and expertise. This can be accomplished by cutting an opening in the stern hull of the kayak, mounting a skeg box that has the pivot mechanism inside, then sealing the box to the raw opening. Keep in mind that once this is mounted in place, it is very difficult to re-align the rigid skeg blade with the virtual keel line. Another inherent problem is that the pivot point is below the surface of the water, which makes the hull vulnerable to leaks. The control linkage then needs to exit through the surface of the deck, and becomes a possible leak as well. A typical kayak with a retractable inboard skeg consumes some of the dry storage available, is very difficult to service while the kayak is in deep water and can be jammed by any small amount of debris, like a pebble from the beach. It can be difficult to resolve a jamming problem, since the mechanism is enclosed inside the hull, and the skeg blade is submersed.

PRIOR ART

The following list is a compilation of searches in the technical field of the invention, which are noted to assist the Patent Examiner.

| | | |
|---|---|---|
| Reference: Des.315,772 | Date of Patent: Mar. 26, 1991 | Patentee: St. John |
| Reference: Des.343,437 | Date of Patent: Jan. 18, 1994 | Patentee: De Paoli |
| Reference: 3,352,272 | Date of Patent: Nov. 14, 1967 | Patentee: J. H. Brazier |

-continued

| | | |
|---|---|---|
| Reference: 3,516,100 | Date of Patent: Jun. 23, 1970 | Patentee: R. Ellis |
| Reference: 3,575,124 | Date of Patent: Apr. 13, 1971 | Patentee: Alter |
| Reference: 3,707,935 | Date of Patent: Jan. 2, 1973 | Patentee: Rachie |
| Reference: 3,728,983 | Date of Patent: Apr. 24, 1973 | Patentee: Ingham |
| Reference: 3,752,105 | Date of Patent: Aug. 14, 1973 | Patentee: Hackett |
| Reference: 3,902,441 | Date of Patent: Sep. 2, 1975 | Patentee: |
| Reference: 3,921,561 | Date of Patent: Nov. 25, 1975 | Patentee: |
| Reference: 3,946,693 | Date of Patent: Mar. 30, 1976 | Patentee: Brown |
| Reference: 4,008,677 | Date of Patent: Feb. 22, 1977 | Patentee: Wordell, Sr. |
| Reference: 4,211,180 | Date of Patent: Jul. 8, 1980 | Patentee: Brooks, Jr. |
| Reference: 4,320,546 | Date of Patent: Mar. 23, 1982 | Patentee: Knox |
| Reference: 4,326,479 | Date of Patent: Apr. 27, 1982 | Patentee: Kawasaki |
| Reference: 4,789,368 | Date of Patent: Dec. 8, 1988 | Patentee: |
| Reference: 4,805,546 | Date of Patent: Feb. 21, 1989 | Patentee: Geller et al. |
| Reference: 4,807,553 | Date of Patent: Feb. 28, 1989 | Patentee: |
| Reference: 4,883,436 | Date of Patent: Nov. 28, 1989 | Patentee: |
| Reference: 5,235,926 | Date of Patent: Aug. 17, 1993 | Patentee: Jones |

SUMMARY OF THE INVENTION

This invention can greatly improve linear tracking, general stability and overall versatility on aquatic vessels.

The preferred embodiment of the invention also resolves many of the disadvantages associated with previous versions of submerged retractable skeg designs. It does not use any space inside the hull, does not leave any holes in the deck or hull, the skeg blades are easily accessible and replaceable, safety features are designed into it, minimal effort is required to install, assemble and use this invention.

Safety features include:

Flexible skeg blades, that pivot to reduce the chance of creating a rigid fulcrum hazard when the skeg blade strikes an obstacle;

The control line has a safety release knot designed into it, so an operators recovery would not be hindered by the control lines strength, if it were caught on a obstacle;

The control line anchor locations are away from the normal sweeping path of a paddle stroke, this reduces the chance of an injury due to a person's hand coming in contact with the hardware during a paddle stroke;

The shape of said anchors is such that it avoids entanglement with an obstacle;

An interference with the mount bracket is designed into the hinge bracket to prevent the skeg blades from pivoting too far above the stern deck, which could hinder a recovery effort of an overturned kayak.

Other aquatic applications could include, but not be limited to, using it on the motor mount of a fisherman's float tube, an inflatable raft, personal fishing pontoon, boat or on a canoe.

BRIEF DESCRIPTION OF THE DRAWING VIEWS

Referring to the accompanying drawings which are for illustrative purposes:

FIG. 7 is a front elevational view of the actuator linkage.

FIG. 8 is a side view of FIG. 7, showing the coaxial ends.

FIG. 9 is a top plan view of the hinged bracket.

FIG. 10 is the port side view of FIG. 9.

FIG. 11 is the front elevational view FIG. 9.

FIG. 12 is an exploded view of the hinged bracket assembly, showing multiple skeg blades.

FIG. 13 is an enlarged detail view of FIG. 12, showing two blades stacked together.

DESCRIPTION OF THE PREFERRED EMBODIMENT

Figure 1:
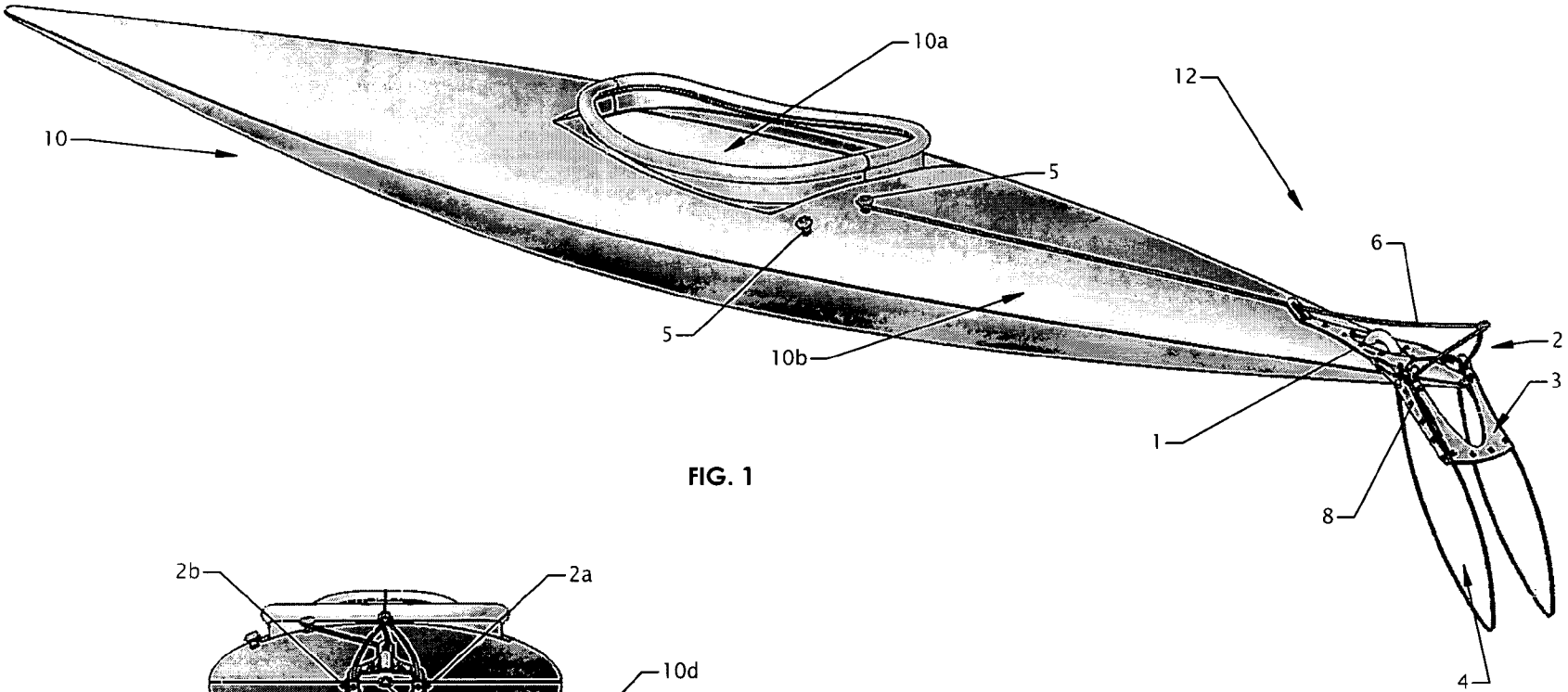
FIG. 1 is a port side perspective view of a kayak having the preferred embodiment of the invention mounted on the stern, and in the deployed position.

In the drawings, all figures have a number preceded by the word 'FIG.', all components have their own number, and any feature associated with the component has the component number which is then appended with an alphabetical character.

Referring now to the drawings, FIG. 1 shows a linear tracking device working assembly 12 mounted onto the stern 10*b* of a kayak 10, which will be referred to as the vessel from this point on.

Figure 4:
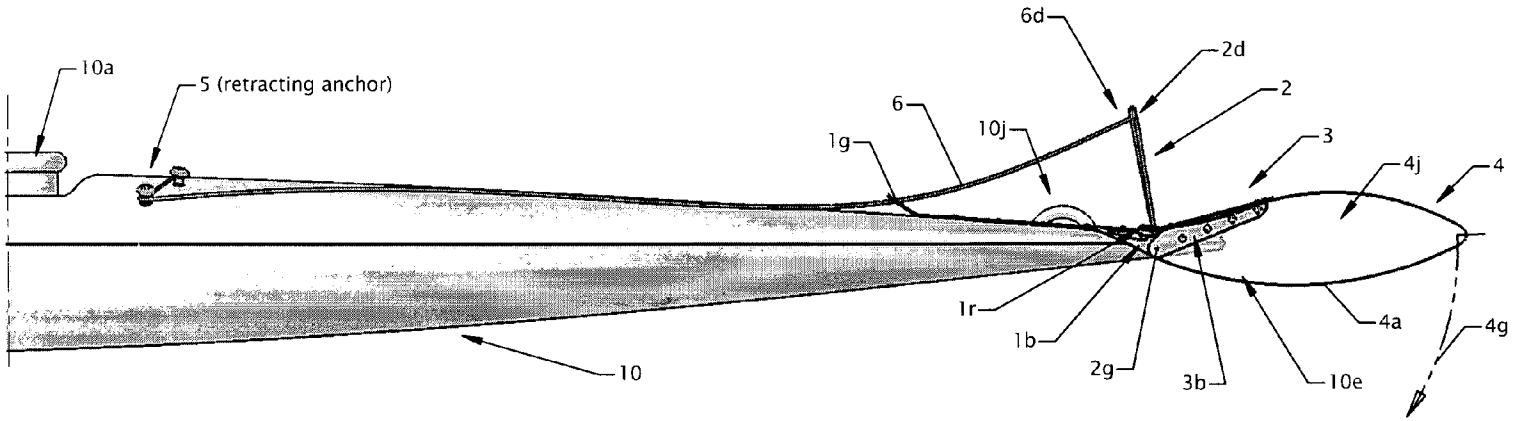
FIG. 4 is the port side view of FIG. 3.
Figure 5:
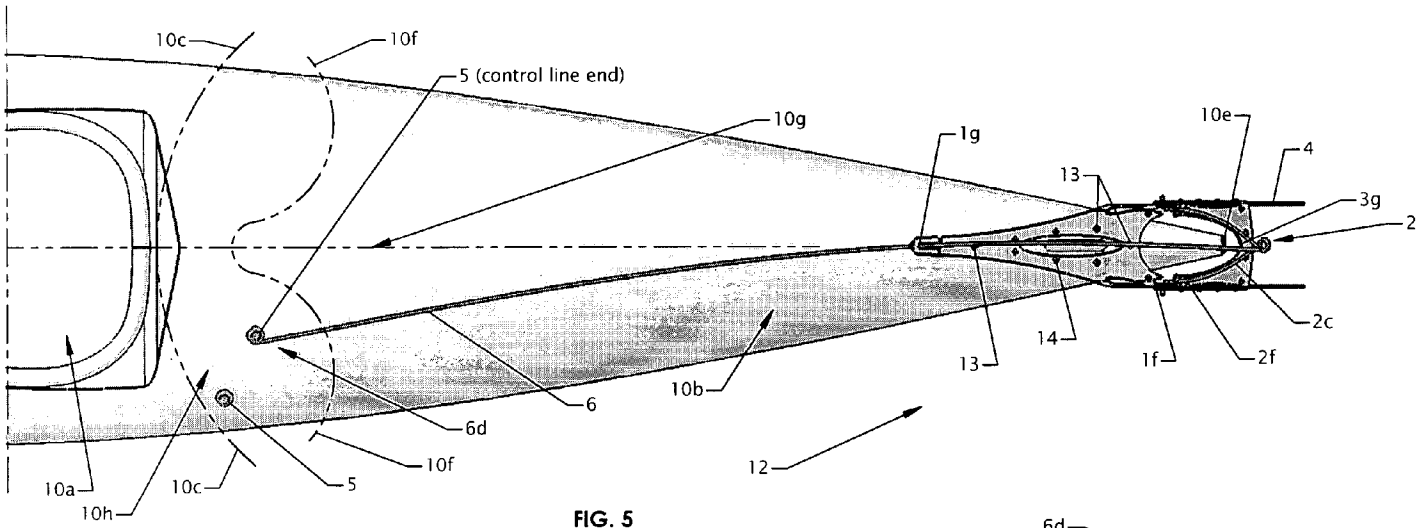
FIG. 5 is the top plan view of FIG. 1, showing the relationships between the operator's reach and the inventions control line, and the clearance of the invention at the tip of the stern.
Figure 6:
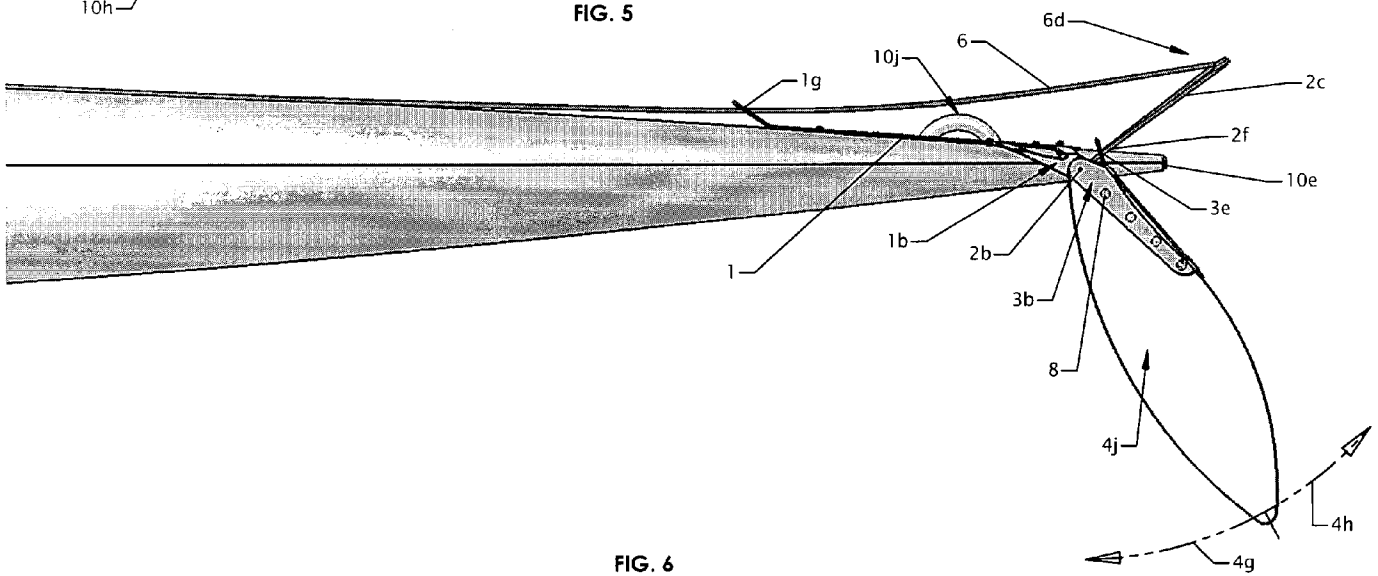
FIG. 6 is an enlarged view of FIG. 5, showing motion about a generally horizontal axis.
Figure 17:
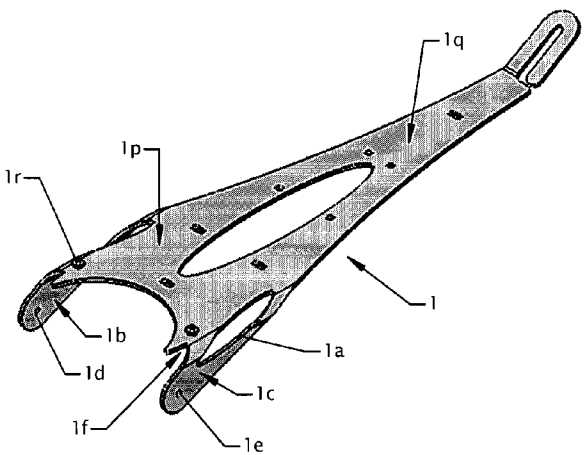
FIG. 17 is a perspective view of the starboard side of the mounting bracket.
Figure 19:
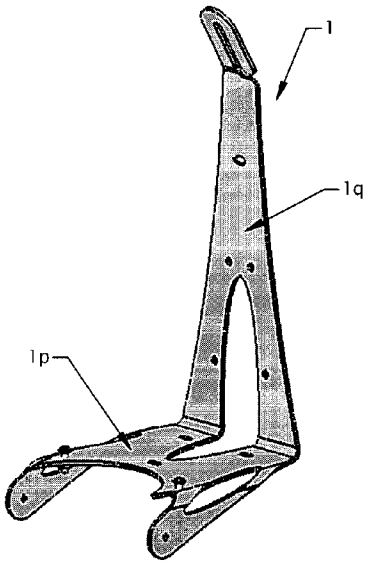
FIG. 19 is a perspective view of the starboard side of FIG. 17, in an alternate embodiment that can be mounted on a generally vertical surface.
Figure 18:
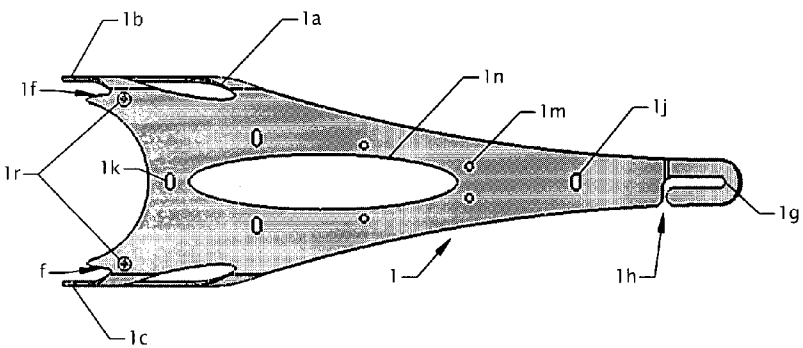
FIG. 18 is a top plan view FIG. 17.

Mount Bracket 1, direction attention FIG. 18, is formed from a man made material rated for outdoor use. Said bracket has a control line guide 1*g*, a flange 1*b* with pivot feature 1*d*, another flange 1*c* with pivot feature 1*e*. Said flanges 1*b* and 1*c* are parallel and pivot features 1*e* are 1*d* coaxial. Other features of Mount Bracket 1 may include hardware mounting features 1*j*, 1*k* and 1*m*, a flow relief hole 1*a*, and an existing vessel accessory 10*j* clearance hole 1*n*. Further details of mount bracket 1 include guide detail 1*h* that avoids having to thread the end of the control line loop 6*d* through the guide 1*g*. The actuator seating detail 1*f* is for capturing the actuator leg 2*f* while the invention 12 is in the retracted position, this relationship is best shown in FIG. 5. Direction attention to FIG. 4, while the hinged bracket 3 is in the retracted position, surface 3*k* rests on an adjustable surface 1*r*, which allows the angular relationship between 1*p* and 3*h* to be adjusted for differing vessel stern deck 10*b* configurations. The mount bracket 1, direction attention FIG. 17, can be mounted with the pivot features 1*d* and 1*e* ahead of, or behind, the stern tip 10*e*, direction attention FIG. 6. Direction attention FIG. 17, mount bracket hinge axis features 1*d* and 1*e*, are concentric with actuator features 2*a* and 2*b*, and are also concentric with, direction attention FIG. 10, the hinged accessory bracket pivot feature 3*d* to maintain parallel alignment between the virtual keel 10*g* and the skeg mechanism 4, while the invention is in the preferred embodiment. Direction attention to FIG. 19, said mount bracket has surfaces 1*p* and 1*q* at an angular relationship, which will allow the mount bracket 1 to be mounted on a generally vertical surface, in relation to the generally horizontal waters surface.

Figure 2:
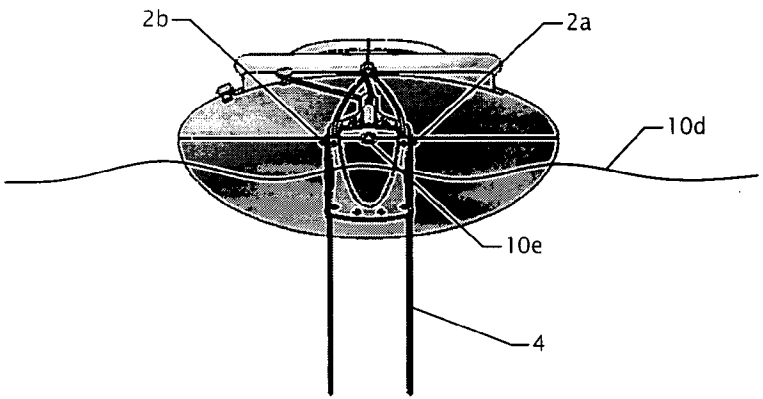
FIG. 2 is a rear elevational view of FIG. 1, showing the generally horizontal waterline.

Actuator linkage 2, direction attention FIG. 7, is formed from an outdoor rated material that has a different dimension 2*h* when it is removed from the invention assembly 12. Direction attention to FIG. 5, said linkage 2 is formed in a shape 2*c* that will avoid interference with the tip of a vessel stern 10*e*. Direction attention to FIG. 8, actuator linkage 2 has two pivot surfaces 2*a* and 2*b* that are coaxial with each other when installed into the inventions assembly 12, surfaces 2*a* and 2*b* are used as the coaxial link between the mount bracket 1 and the hinged bracket 3. Surfaces 2*a* and 2*b* remain above the generally horizontal water surface 10*d* best shown in FIG. 2. The actuator linkage 2 has a location 2*d* designated for connection of a control line 6, and more specifically loop 6*d*. Direction attention to FIG. 12, either pivot surface end 2*e* or 2*g*, can be used as a tool to release the grasp of the reusable fastener 8, by pushing 8*a* which exposes its core stem surface 8*b*.

Figure 3:
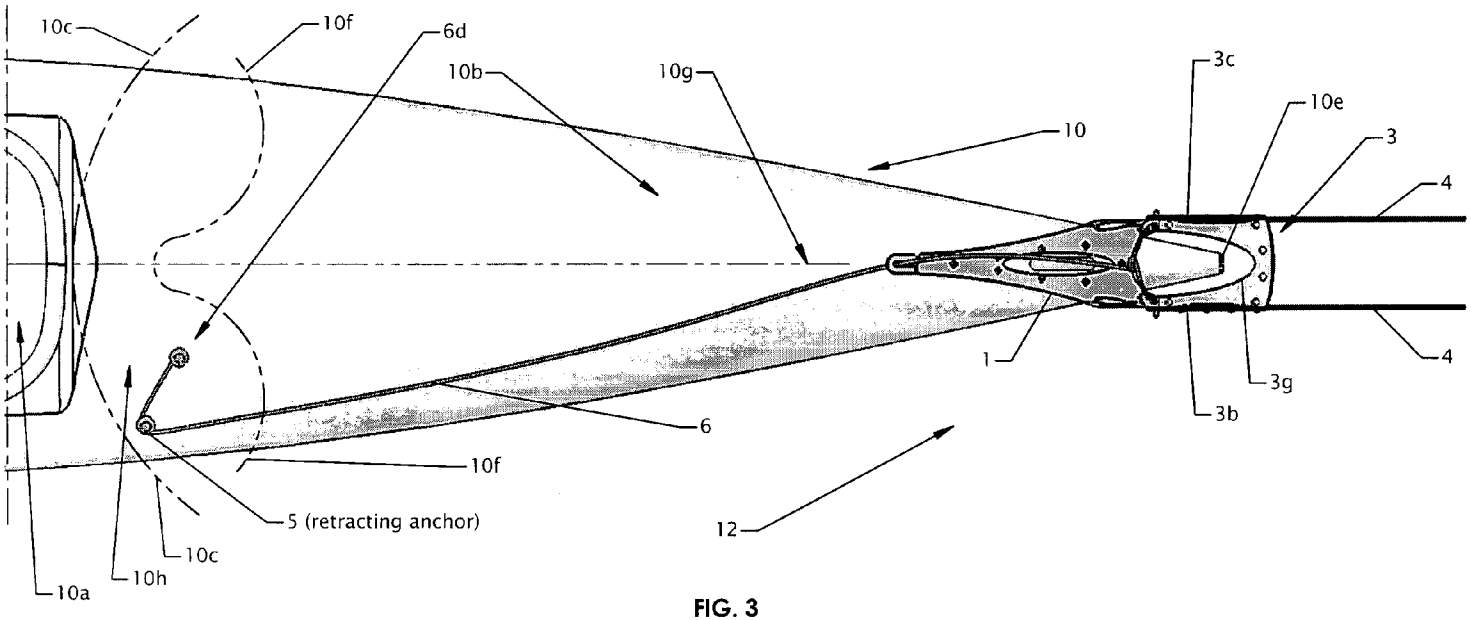
FIG. 3 is the top plan view of the kayak in FIG. 1, showing the relationships between the operator's reach and the inventions control line, while in the retracted position.

Hinged bracket 3 is formed from a man made material rated for outdoor use, has a flange 3*b* with pivot feature 3*d*, at least one accessory 4 fastening detail 3*p*, and can have a flow relief feature 3*a*. Direction attention to FIG. 10, the hinged bracket 3 flanges 3*b* and 3*c* are offset and parallel to the virtual keel line 10*g*, best shown within the preferred embodiment 12 in FIG. 3. Said flanges have their pivot feature 3*d* and mounting features 3*p* aligning in a coaxial arrangement, best shown in FIG. 10. The skeg blade fastening detail 3*p* is capable of holding multiple skeg blades 4 parallel to each other. Hinged bracket 3 has actuator engagement details 3*e* and 3*f*, which bind against the actuator 2 near location 2*f*. Said hinged bracket 3 has material removed 3*g* to avoid contact with the vessel stern tip 10*e* throughout its range of motion about the generally horizontal pivot feature 3*d*. Hinged bracket 3 also has a relatively small surface area 3*h* to minimize drag while in the deployed position FIG. 6 of the invention assembly 12. Hinged bracket 3 may have one or more auxiliary fastener holes 3*m*. A mechanical interference between the hinged bracket 3 at surface 3*k* and mount bracket 1 at surface 1*r* will prevent the invention assembly 12 from having a high angle relative to surfaces 3*h* and 1*p*, when in the retracted position. Direction attention to FIG. 4, this mechanical interference is a safety feature intended to prevent the skeg mechanism 4 surface area 4*j* from hindering the corrective efforts of an over turned vessel 10.

The skeg mechanism 4, direction attention FIG. 12, is made from a man made material rated for outdoor use, is durable, flexible and has a uniform thickness. The skeg blade 4 in the invention assembly 12 is shown as a transparent material, but is not limited to having any translucent qualities. The leading edge 4*a* and trailing edge 4*c* of the blade 4 will not hold onto an undesirable obstacle. Upon either said edge coming in contact with an obstacle while in the deployed position FIG. 6 the skeg blade 4 will cause the rotation of the hinge bracket 3 about the pivot axis 2*b* in directions 4*g* or 4*h*. Features of the blade include at least one mechanical fastener location 4*f*, an open-ended slot 4*e* connected with pivot alignment hole 4*d*. Said blade has a surface 4*b* which is intended as a friction reducer between the mount bracket flange 1*b* and hinged bracket flange 3*b*. Said skeg blades 4 can be stacked next to each other FIG. 13 and allows the vessels handling characteristics to be fine tuned. Said stacking of the skeg blades 4 can not be modified by the operator when they are seated in the vessel 10 cockpit 10*a*.

Figure 15:
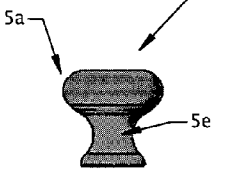
FIG. 15 is the front elevational view of the control line anchor.
Figure 16:
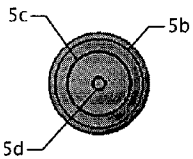
FIG. 16 is the mounting base of FIG. 15.

The control line anchor 5, direction attention FIG. 15, is an optional item to be used with the invention assembly 12. The anchor 5 and the control line 6 are only required, if the skeg blade 4 needs to be retracted FIG. 4 while the operator is using the invention 12. Direction attention to FIG. 16, the control line anchor 5 is made from a man made material rated for outdoor use, has a large perimeter dimension 5*b*, and at least one smaller dimension 5*c* along its core, to create a feature 5*e* to hold the control line 6. Said anchor 5 has a feature 5*d* to mechanically fasten it to a surface 10*h* and has no sharp edges 5*a* when installed. Said control line anchor 5 is mounted to the deck of the vessel in the area between the general range of motion limits 10*c* and the general reach limits 10*f* of the operator. If the option of retracting the hinged bracket 3 is chosen, control line anchor 5 is used to accomplish two separate tasks. The first is shown in FIG. 5 and notes the location for the control line end anchor 5 that receives the control line end loop 6*d* which is tightened around surface 5*e*. The second purpose is best shown in FIG. 4 and details the location of the retracting anchor 5 that sets the retracted position of the control line 6, to have a tangency relation to surface 5*e*, which brings the hinged bracket 3 into the retracted position. More control line anchor 5 locations may be desired to manipulate the control line 6 around an obstacle such as gear strapped to the stern deck 10*b*.

Figure 14:
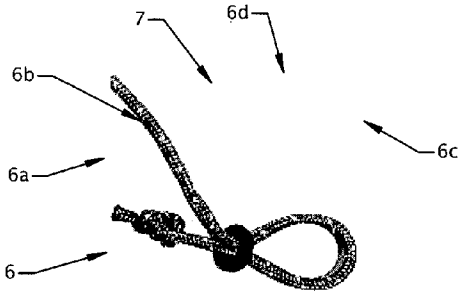
FIG. 14 is a detail view of the safety knot at the end of the control line.

The control line 6, direction attention FIG. 14, is a standard high strength man made cord and is rated for outdoor use. Said control line 6 is a basic reach extender for the operator, intended to manipulate the hinged bracket assembly 3. Said control line 6 has a safety release loop 6*d* located near each tag end 6*a* and inline knot 6*b*. The safety release loop is created by folding the control line 6 forming a 180 degree turn at 6*c*, then slide the tight fitting resilient collar 7 over 6*c*. This creates a noose that will deform and fail well below the control lines 6 capacity. This is another safety feature to avoid hindering a recovery effort if the control line 6 were to get caught on an undesirable obstacle. This invention is not limited to a soft type of linkage shown, it can have a rigid, or semi rigid linkage system to control the assembly 12. The soft linkage shown consists of components that are inexpensive, lightweight, and simple to operate and install.

The fasteners 8 are not original to this invention and are of a reusable type rated for outdoor use.

Figure 22:
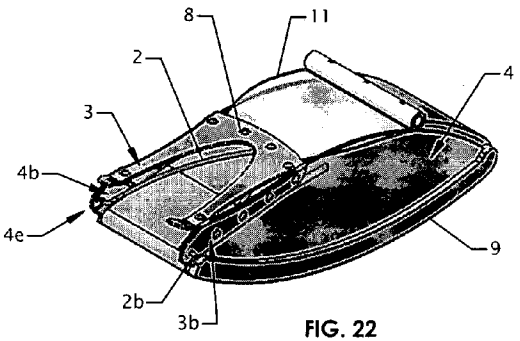
FIG. 22 is a port side perspective view of FIG. 20.
Figure 25:
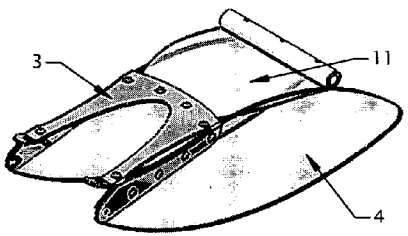
FIG. 25 is a port side perspective view of FIG. 23.
Figure 21:
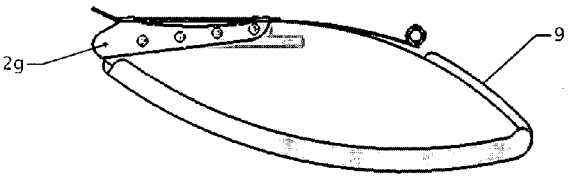
FIG. 21 is the port side view of FIG. 20.

The storage block 9, direction attention FIG. 21, is made of a lightweight, buoyant man made material that is rated for outdoor use. Direction attention to FIG. 11, said storage block when fitted between the flanges 3*c* and 3*b* of the hinge bracket 3, holds the skeg blade surface 4*j* parallel to the flange. Direction attention to FIG. 22, storage block 9 can hold the actuator 2 in place when this subassembly is stored separate from the invention assembly 12.

The vessel 10, direction attention FIG. 1, is not original to this invention, but is shown as a vessel on which the invention assembly 12 is mounted. Features noted are the cockpit 10*a*, stern 10*b*, the operators general range of motion 10*c*, generally horizontal waterline 10*d*, the tip of the stern 10*e*, the operators general reach 10*f*, virtual keel line 10*g*, the area 10*h* within reach of the operator while seated in the cockpit 10*a*. Said vessel may have an existing accessory 10*j*, which is shown to emphasize the mounting brackets 1 versatility. Attention direction to FIG. 28, heading deviation forces are generalized by 10*x* and 10*y*. In this set of illustrations any aquatic vessel could be substituted for the one shown in the drawing views including, but not limited to, a raft, an inflatable boat, a fisherman's float tube, a fisherman's personal pontoon or a boat. In the case of a vessel having a generally vertical surface, perpendicular to the longitudinal keel, the embodiment shown in FIG. 19 would be used. Also note this device will work as a kite tail, if it is made of lighter weight materials. For a kite tail embodiment the operators' location would be interpreted as the operator being located at the end of a controlling device, and the cockpit will be interpreted as the location for which control is distributed once control is translated to said kite.

Figure 23:
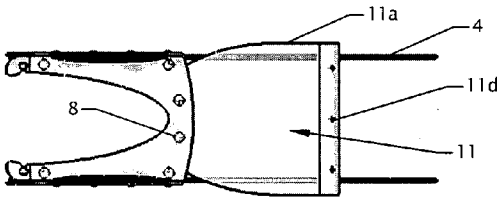
FIG. 23 is a top plan view of the hinged bracket assembly, with one accessory.
Figure 24:
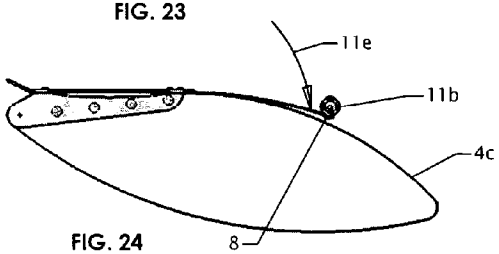
FIG. 24 is the port side view of FIG. 23.

The flexible hinged bracket extension 11, direction attention FIG. 23, is made from a man made material rated for outdoor use, is very flexible, durable and has a uniform thickness. Features of this accessory are that it flexes above the skeg blade trailing edge 4*c* when the invention is in motion in a forward direction. It also utilizes the skeg blade trailing edge 4*c* as a reinforcing rib when a force is applied 11*e* and the outward edge 11*a* and the stiffening detail 11*b* has interference with the skeg blade trailing edge 4*c*. Said bracket extension 11 has at least one mechanical fastener location at 11*c* and again at 11*d*, and can be assembled with the same reusable fastener 8 shown in FIG. 12. The intent of this accessory is to make use of kinetic energy in the surrounding environment such as a river current or a wave, which can translate the force 11*e*, into forward motion for the vessel 10.

The retractable working assembly of the invention 12, direction attention FIG. 1, is comprised of all of the parts previously mentioned in the preferred embodiment description, and the mounting hardware noted hereafter.

The adjustable compression fastener 13, direction attention to FIG. 5, is made from a man made material rated for outdoor use. Said fastener is to be used to hold the mount bracket 1, to the stern of the vessel 10. Mount bracket 1, direction attention to FIG. 18, has fastener details 1*j* and 1*k* to allow for the adjustment of the linear tracking device 12 to have a parallel relation to the virtual keel line 10*g*. Said fastener 13 is also used to mount the control line anchor 5 at feature 5*d* to the vessel.

The fixed hardware fasteners 14, direction attention to FIG. 5, are made from a man made material rated for outdoor use. Said fastener is to be used to secure the mount bracket 1 into a true position, as to avoid the assembly 12 from getting bumped out of alignment. All of the fastener 13 and 14 mounting holes can be completely weatherproofed.

Figure 27:
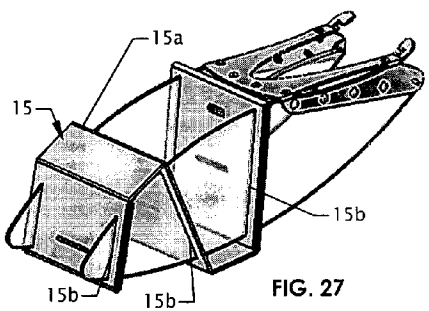
FIG. 27 is a perspective view of the starboard side of the shipping card for the hinged bracket assembly, ready to be stored separately from the complete assembly shown in FIG. 1.
Figure 26:
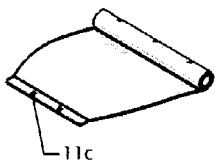
FIG. 26 is a port side perspective view of the accessory in FIG. 23.
Figure 20:
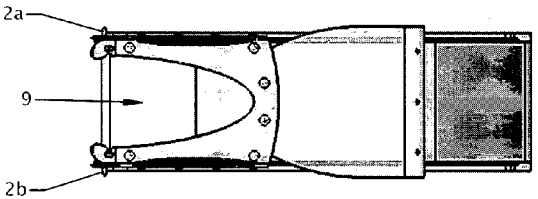
FIG. 20 is a top plan view of the hinged bracket assembly with two accessories, and ready to be stored separately from the complete assembly shown in FIG. 1.

The shipping card 15, direction attention to FIG. 27, is made from a man made material rated for outdoor use. Said shipping card, is an alternate embodiment of the storage block 9, and is intended to hold the skeg blades rigidly, in their desired posture, during storage or during transport. Said shipping card 15 has at least one bend 15*a*, and multiple vertical slots 15*b* to capture skeg blade surfaces 4*j*.

The initial installation of this invention is accomplished with common tools and does not require expertise in a given trade. Direction attention FIG. 5, the mount bracket 1 must be installed with four fasteners 13, then it is then adjusted parallel to the keel line 10*g*, and finally can be secured in place with fasteners 14. The hinge bracket 3 and the actuator 2 need to be assembled to the mount bracket 1 aligning coaxial features 1*d*, 2*b* and 3*d*. Direction attention FIG. 5, the control line end anchor 5 can be located within the seated operators reach 10*f*. Direction attention FIG. 4, one end of control line 6 at loop 6*d* needs to be connected to the actuator 2 at location 2*d* in order to locate the placement of the control line retracting anchor 5 to be mounted on the vessel 10 within area 10*h*. This is also necessary to establish the overall length of the control line 6, to allow full deployment and retraction.

Figure 29:
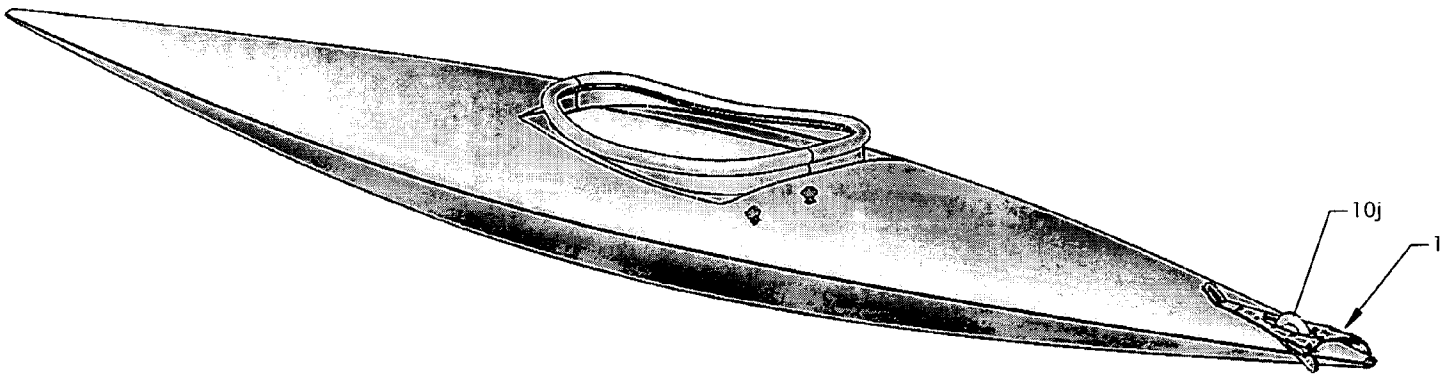
FIG. 29 is a port side perspective view of FIG. 28.

Once the initial installation has been completed, the invention 12 can be assembled FIG. 1 or disassembled FIG. 29 at any time, in a matter of seconds. The control line anchors 5 and the mount bracket 1 stay attached to the vessel 10. To accommodate transportation of the vessel, the hinged bracket 3 along with any attached parts, the actuator 2 and the control line 6 can remain assembled as shown in FIG. 4, or can be removed and stowed separate, direction attention to FIG. 22 and FIG. 27, from the vessel 10.

To separate the hinged bracket 3 and its attached parts, from the preferred embodiment 12 shown in FIG. 1, a person must compress the actuator 2 at areas 2*c* best shown in FIG. 7. This process reduces the dimension 2*h* and releases the actuator leg 2*f* through features 3*e* and 3*f* of the hinged bracket 3, best shown in FIG. 9. This also releases the actuator 2 from the mount bracket 1 by compressing 2*h* to allow 2*e* and 2*g* through mount bracket 1 features 1*d* and 1*e*. All loose parts can then be gathered and handled independent of the vessel 10.

Figure 28:
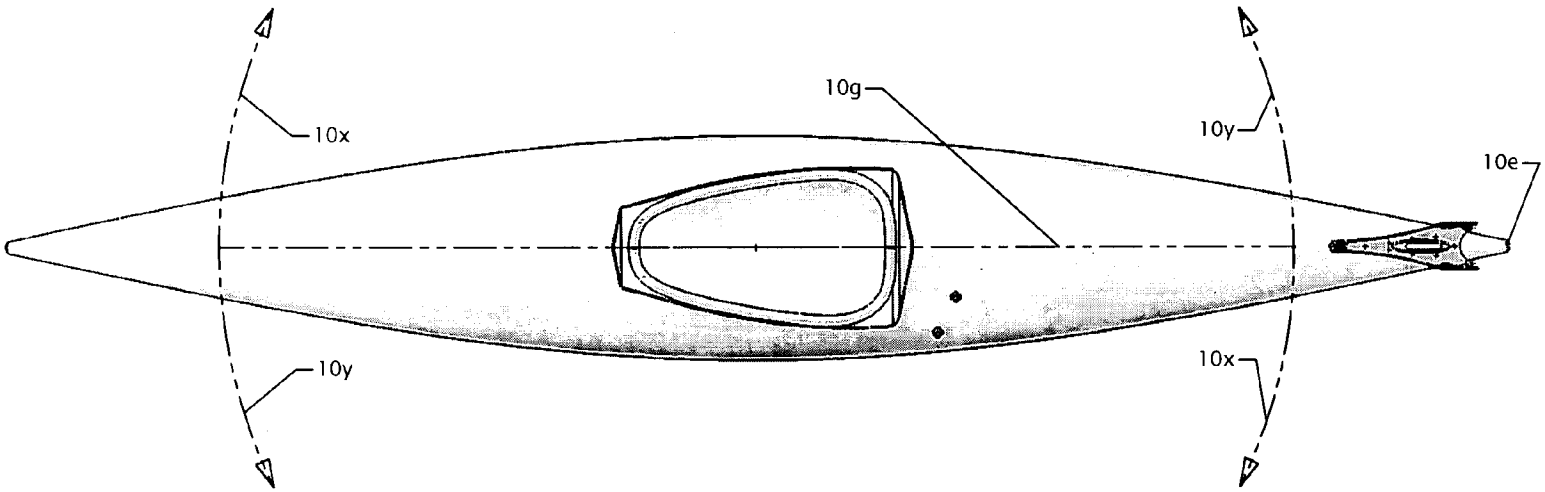
FIG. 28 is a top plan view with the hinged assembly and the control mechanism removed.

Direction attention to FIG. 28, heading deviation forces 10*x* or 10*y* can be partially or completely neutralized by the invention 12 shown in FIG. 1, and are not limited to wind, waves, current, primary propulsion or secondary propulsion method.

Direction attention to FIG. 29, shows the ability of the mount bracket 1 to avoid any existing hand hold devices 10*j* that may be part of the vessel 10.

Direction attention to FIG. 1, to use the invention 12 an operator seated in the cockpit 10*a* would propel forward at their leisure until a change in direction is desired. Direction attention to FIG. 5, the operator would then reach to the area 10*h* and swipe with their thumb to catch the control line 6 and loop it to the retracting anchor 5 location, best noted in FIG. 3. With the hinged bracket 3 in the retracted position FIG. 4, the operator can make an aggressive course change. When the operator requires a more linear course, they would then release the control line 6 from the retracting anchor 5 location, which uses gravity to deploy the hinged bracket 3 and any attached skeg blade 4. The actuator 2 feature 2*d* is visible by the operator seated in the cockpit 10*a*, to allow confirmation of the true position of the hinged bracket 3 assembly in regard to it being fully retracted or deployed.

What is claimed is:

1. An outboard mounted skeg mechanism for a kayak comprising:

a mounting bracket with a rearwardly located generally horizontal pivot axis;

a hinged accessory bracket with a forwardly located generally horizontal pivot axis;

a provision for multiple skeg blade mounting on said accessory bracket;

multiple skeg blades fastened on said accessory bracket;

an operator control mechanism comprising a single control line, anchored at one end within the reach of the operator, and the other end attached to a device actuator;

the device actuator with a leverage advantage, and axis alignment features;

a means to install and utilize said components on a stem deck of a kayak;

wherein said mounting bracket is aligned so the pivot axis locations are perpendicular to the virtual keel line of a kayak, and is secured near the end of the stern deck;

wherein said device actuator connects said hinged accessory bracket to the mounting bracket about their generally horizontally pivot locations;

wherein said device actuator extends a leverage point to the operator through said control line, to employ and deploy said accessory bracket.

2. The invention of claim 1, wherein the skeg blades are made of a partially flexible material that has a memory of its unstressed state.

3. The invention of claim 1, in which: said device actuator leverage point is generally above said horizontal pivot axis, and is mechanically linked to said accessory bracket, wherein said device actuator leverage point travels parallel to the virtual keel.

* * * * *